US006584715B2

(12) United States Patent
Fujii et al.

(10) Patent No.: US 6,584,715 B2
(45) Date of Patent: Jul. 1, 2003

(54) DOOR FOR AUTOMATIC VENDING MACHINE

(75) Inventors: Toshiro Fujii, Saitama-ken (JP); Takuya Koyanagi, Saitama-ken (JP); Tsugio Hanyuda, Gunma-ken (JP); Koji Hachii, Saitama-ken (JP); Toshiyuki Horiguchi, Gunma-ken (JP); Kenji Sakanoue, Saitama-ken (JP)

(73) Assignee: Fuji Electric Co., Ltd., Kanagawa (JP)

( * ) Notice: Subject to any disclaimer, the term of this patent is extended or adjusted under 35 U.S.C. 154(b) by 29 days.

(21) Appl. No.: 09/864,262

(22) Filed: May 25, 2001

(65) Prior Publication Data

US 2002/0026735 A1 Mar. 7, 2002

(30) Foreign Application Priority Data

Sep. 5, 2000 (JP) ..... 2000-269015

(51) Int. Cl.[7] ..... G09F 7/00

(52) U.S. Cl. ..... 40/584; D20/1; D20/4; D20/5

(58) Field of Search ..... 40/584, 545, 549, 40/564, 618; D20/1, 3, 4, 5

(56) References Cited

U.S. PATENT DOCUMENTS

D269,093 S * 5/1983 Bachmann et al. ..... D20/5
4,454,670 A * 6/1984 Bachmann et al. ..... 40/584
4,551,935 A * 11/1985 Bachmann et al. ..... 40/584
D316,567 S * 4/1991 Beckles ..... D20/5
D382,905 S * 8/1997 Antao et al. ..... D20/5
D386,791 S * 11/1997 Antao et al. ..... D20/5
D410,035 S * 5/1999 Johnson et al. ..... D20/5
D434,446 S * 11/2000 Hanyuda et al. ..... D20/4
D442,994 S * 5/2001 Hanyuda et al. ..... D20/4

* cited by examiner

*Primary Examiner*—S. Joseph Morano
*Assistant Examiner*—Jason R. Bellinger
(74) *Attorney, Agent, or Firm*—Sughrue Mion, PLLC

(57) ABSTRACT

A door for automatic vending machine in which a door structure having an item sample display unit is,improved according to the invention. In the door for the automatic vending machine, a concave portion 5 of a large door 2 made by one press molding is available for an item sample display unit 3 in which the item samples 6 are displayed on each of three stairs, four fluorescent lamps 7 illuminating the item samples 6 and an advertisement 8 provided under the item samples 6 are installed, each of three lamps being provided on lower portion of the item samples 6 and the other one of the lamps being provided on uppermost portion of the item sample display unit 3, and circumference of the item sample display unit 3 is covered with a small door 4 made by a transparent material 10 and having a frame 9.

2 Claims, 7 Drawing Sheets

DOOR FOR AUTOMATIC VENDING MACHINE

FIELD OF THE INVENTION

The present invention relates to a door structure for an automatic vending machine which has an item sample display unit.

BACKGROUND OF THE INVENTION

A conventional automatic vending machine having an item sample display unit installed in a door is shown in FIG. 1. In FIG. 1, a large door 40 is installed on the front surface of automatic vending machine 45, a middle door 41 is installed inside the large door 40 so that it may open and close by rotating around the center of supporting axis, an item sample 6 in the form substantially same as items to be sold and an advertisement 8 are provided on the middle door 41, and a transparent front panel 42 is installed in the large door 40 facing with the item sample 6. For this arrangement, it is necessary to open the large door 40 and then open the middle door 41 in a direction of the arrow in order to exchange the item sample 6 and to clean the inside of the front panel. In case that a wall exists in a left side of the automatic vending machine, the above exchanging and cleaning operations are difficult because both of the large door 40 and the middle door 41 can not be sufficiently open.

The middle door 41 is connected to the large door 40 only by the supporting axis, and therefore the, strength of the middle door 41 and the large door 40 is weak where the middle door 41 is open. Further, the structure of the large door 40 is complicated, and as the number of parts for construction of the door 40 is large the cost of the machine is large.

An item sample display unit 43 installed in the middle door 41 is composed of a plurality of item sample display stands (shelves) 44 which are vertically installed and a fluorescent lamp 7 illuminating the item sample 6 from the upper and lower directions. In one embodiment, the fluorescent lamp 7 is installed inside each of the item sample display stands 44. Another fluorescent lamp 7 is installed on the back surface of the large door 40 in order to illuminate the item sample 6 and the whole of the item sample display unit 43. As a result, connection of the middle door 41 to the large door 40 is unstable because the number of the parts is large and the weight thereof is heavy. Further, power consumption is also large.

As described above, according to the door structure of conventional automatic vending machines, in case that maintenance operation of the item sample display unit 43 is carried out in a place to be installed, maintenance operation has to be implemented by opening the large door 40 and the middle door 41 provided in the back side of the large door 40. Therefore, the operation is troublesome because much time and labor are required to adjust the opening degree of the doors 40, 41 and to set it. Further, because the structure of the large door 40 is complicated, the number of the parts becomes more and the costs thereof are more, improvement has been desired. Also, it has been desired to make the illumination more efficient and to reduce the power consumption and the number of lamps with respect to the fluorescent lamps 7 for illuminating the item sample 6 and the inside of the item sample display unit 43.

SUMMARY OF THE INVENTION

An object of the invention is to provide a door for automatic vending machine having an item sample display unit of which structure is improved.

The object of the invention can be attained by a door for automatic vending machine according to the first invention comprising a display unit for displaying item samples which is a first door unit capable of opening and closing and installed in a front surface of the automatic vending machine.

In the door for automatic vending machine according to the second invention, said door unit and said display unit are made from an iron plate.

In the door for automatic vending machine according the third invention, said door unit and said display unit are made from a plastic resin.

In the door for automatic vending machine according to the fourth invention, said door unit and said display unit are arranged so that the display unit is concave to the front surface of the door unit.

In the door for automatic vending machine according to the fifth invention, said display unit includes the space of the advertisement.

In the door for automatic vending machine according to the sixth invention, said display unit is covered with a transparent second door unit capable of opening and closing.

In the door for automatic vending machine of the first invention to the sixth invention, the display unit is formed with a part of the outside of the first door. As a result, where the maintenance operation is carried out inside the display unit, it can be done by opening only the second door and hence its efficiency is increased. Unlike conventional door structure, since the first door and the display unit are a single molding, they are strengthened, the items are hardly robbed from the automatic vending machine, and the structure of the door can be simplified. Further, the inside structure of the display unit becomes simple, looks better and is easily cleaned.

In the door for automatic vending machine according to the seventh invention, said item samples are arranged in a plurality of rows in said display unit, so that the item samples in the center row or near the center row are curved toward the back surface of the door unit and so that the item samples in the row higher than those in or near the center row are declined downward and the item samples in the row lower than those in or near the center row are declined upward, and an illumination lamp is installed in an upper portion of the item samples in the uppermost row and in a lower portion of the item samples in the lowermost, respectively.

In the door for automatic vending machine according to the eighth invention, said item samples are arranged in a plurality of rows in said display unit, so that the item samples in the center portion or near the center portion are curved toward the back surface of the door unit and so that the item samples in the left side of the center portion are declined to the right and the item samples in the right side of the center portion are declined to the left, and an illumination lamp is installed in the left side of the item samples in the most left side and in the right side of the item samples in the most right side, respectively.

According to the door for automatic vending machine of the seventh invention to the ninth invention, in addition to the effects of the first invention, the number of the illumination lamps can be reduced and the power consumption can be reduced not by installing the lamps in a plurality of rows displaying the item samples but by installing the lamps in only two palaces, i.e. in the upper and lower portions of the item samples. As a result, light is uniformly exposed from the illumination lamps to each of the item samples.

In the door for automatic vending machine according to the ninth invention, a concave in a groove form or a convex in a bank form representing concrete or abstract objects is one molding on the surface of said first door unit. According to the ninth invention, in addition to the effects of the first invention, a part of the surface on the large door is made to the concave in the groove form or to the convex in the bank form by one molding. By the three-dimensional shape of the concrete or abstract objects, customer collecting effects are increased and plain surface of the large door is strengthened.

In the door for automatic vending machine according to the tenth invention, a concave or a convex representing concrete or abstract objects is one molding on the surface of the space of the advertisement. According to the tenth invention, in addition to the effects of the first invention, a part of the surface on the display unit is made to the concave in the groove form or to the convex in the bank form by one molding. By the three-dimensional shape of the concrete or abstract objects, customer collecting effects are increased and plain surface of the space of the advertisement for the item samples display is strengthened.

DESCRIPRION OF THE PREFERRED EMBODIMENTS

Figure 1:
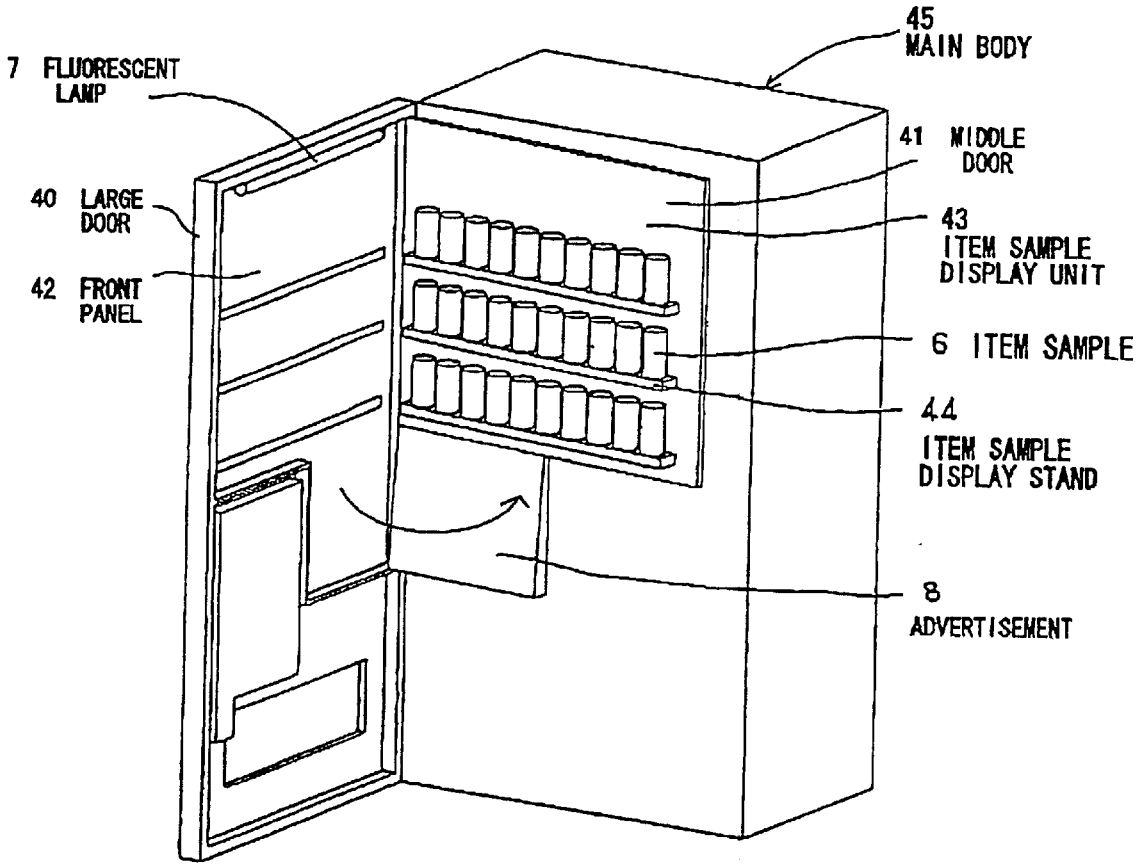
FIG. 1 PRIOR ART
FIG. 1 is a perspective view of conventional whole automatic vending machine.

The embodiments of the invention will be explained referring to the drawings in which the same number is used in case that a structure in the automatic vending machine of the invention are same as one in conventional automatic vending machine.

Figure 2:
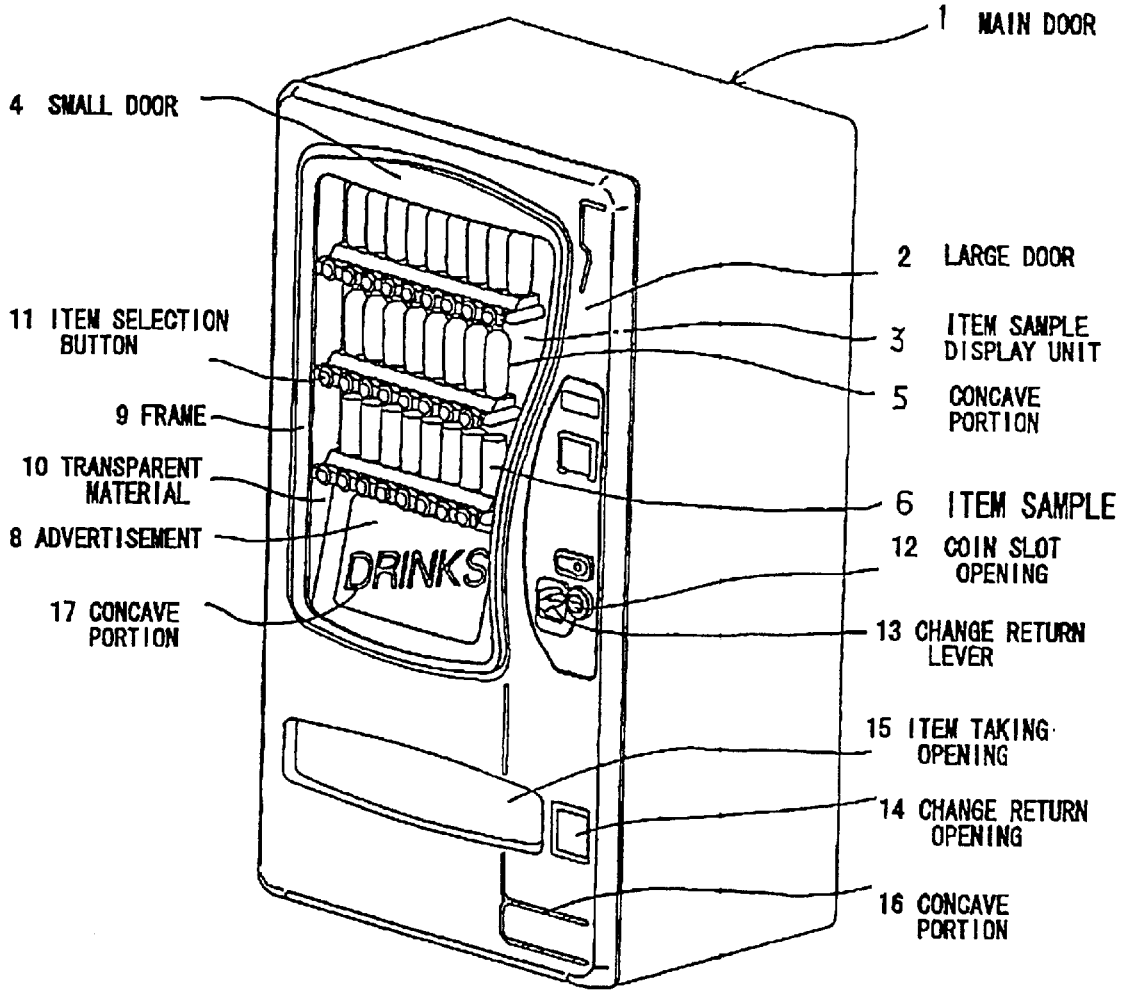
FIG. 2 is a perspective view of whole automatic vending machine with the door showing the first embodiment of the invention.
Figure 3:
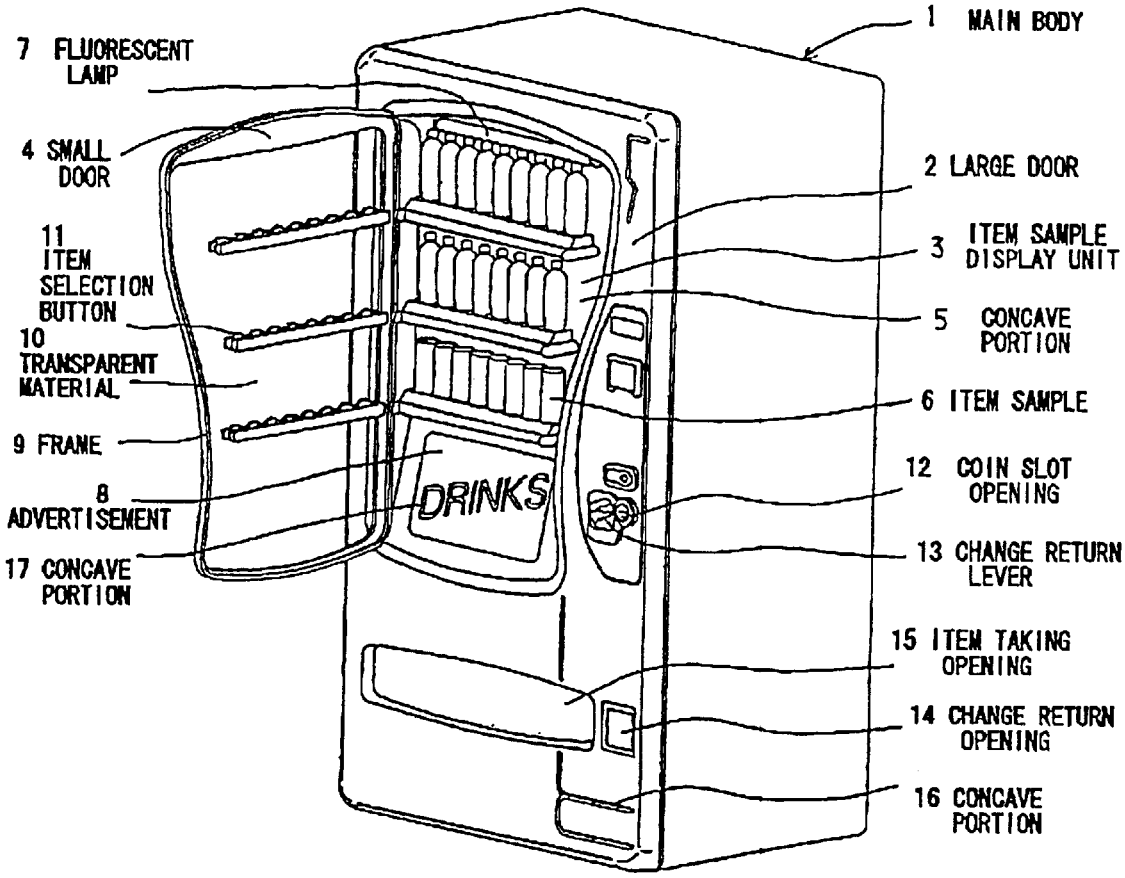
FIG. 3 is a perspective view of whole automatic vending machine with the small door in the open condition showing the first embodiment of the invention.

FIGS. 2 and 3 each is a perspective view of whole automatic vending machine with the door showing the first embodiment of the invention. FIG. 2 shows the condition that the small door is close, and FIG. 3 shows the condition that the small door is open. The large door 2 (the first door unit) is installed on the front surface of the automatic vending machine 1, the item sample display unit 3 (display unit) having the item samples 6 of substantially same shape as that of the items to be sold and the advertisement 8 is installed on a part of the outside of the large door 2, and the small door (second door unit) is installed so that it covers the item sample display unit 3. The large door 2 is formed by one press molding of a molding material such as iron plate and the concave 5 which is a part of the large door 2 is made in the item sample display unit 3, and a plurality of the illumination fluorescent lamps 7 (illumination lamps) is installed in the vertical direction to the item sample display unit 3. Four units of the fluorescent lamps are installed to illuminate the item samples 6 and the space of the advertisement 8. In detail, three of them are installed under the item samples 6 which are arranged on each of three stairs (shelves), respectively and the other one is installed in the uppermost portion of the item sample display unit 3. The item sample display unit 3 is covered with the small door 4 which is made by the transparent material 10 having the frame 9, and therefore, it is possible that the item samples 6 and the advertisement 8 are confirmed through the transparent material 10 from outside of automatic vending machine. Further, the item selection button 11 corresponding to each of the item samples 6 is installed on the small door 4. The concave 16 in the grove form engraving an outline of a (glass) bottle or plastic (PET) bottle is provided on the large door 2. In the space of the advertisement 8 under the item sample display unit 3, the concave 17 engraving pictures, letters, signs, etc. (e.g. DRINKS) for advertisement is provided. The large door 2 can be formed by molding a plate-like plastic resin or by an injection type molding of a pellet-like plastic resin. The coin slot opening 12, the change return lever 13, the change return opening 14 and the item-taking opening are provided near the small door 4.

As described above, since the item sample display unit 3 is installed in a part of the outside of the large door by one press molding of a sheet of iron plate, the maintenance operation in the item sample display unit 3 can be done by only opening the small door 4 and therefore, operation efficiency is improved. While the large door 40 and the middle door 41 are separately formed in conventional automatic vending machines as shown in FIG. 1, the large door 2 and the item sample display unit 3 are formed by one molding in the embodiment of the invention and hence, according to the invention, the strength of the large door is increased and the structure thereof becomes simple. Further, a gap between combined parts is less in the invention, because the number of the combined parts in item sample display unit 3 is less than that in conventional automatic vending machine. As a result, it is possible to protect the automatic vending machine from robbery of the item samples and coins/bills by breaking item sample display unit 3 open. According to the automatic vending machine of the invention, it is possible to collect customers because of simple structure and better looking in design of the large door 2 formed by one molding, and it is realized that the structure in the item sample display unit 3 is made to be able to clean easily and the weight of the door is reduced. The outline of a (glass) bottle or plastic (PET) bottle is made in the three dimensional form by one molding of the concave 16 with a part of the surface of the large door 2, whereby the customer collection effects become higher and the strength of the plane surface in the large door 2 is increased. The letters such as DRINKS are provided, without printing, in the three dimensional form by one molding of the concave 17 with a part of the surface of the item sample display unit 3, whereby the strength of the plane surface on the advertisement 8 in the item sample display unit 3 is increased. The customer collection effects are more increased by adhering a medium such as a poster to the space of the advertisement 8. Where a plastic resin is used as a material for the large door 2, the weight of the door 2 is more reduced than in the door using a steal plate.

Figure 4:
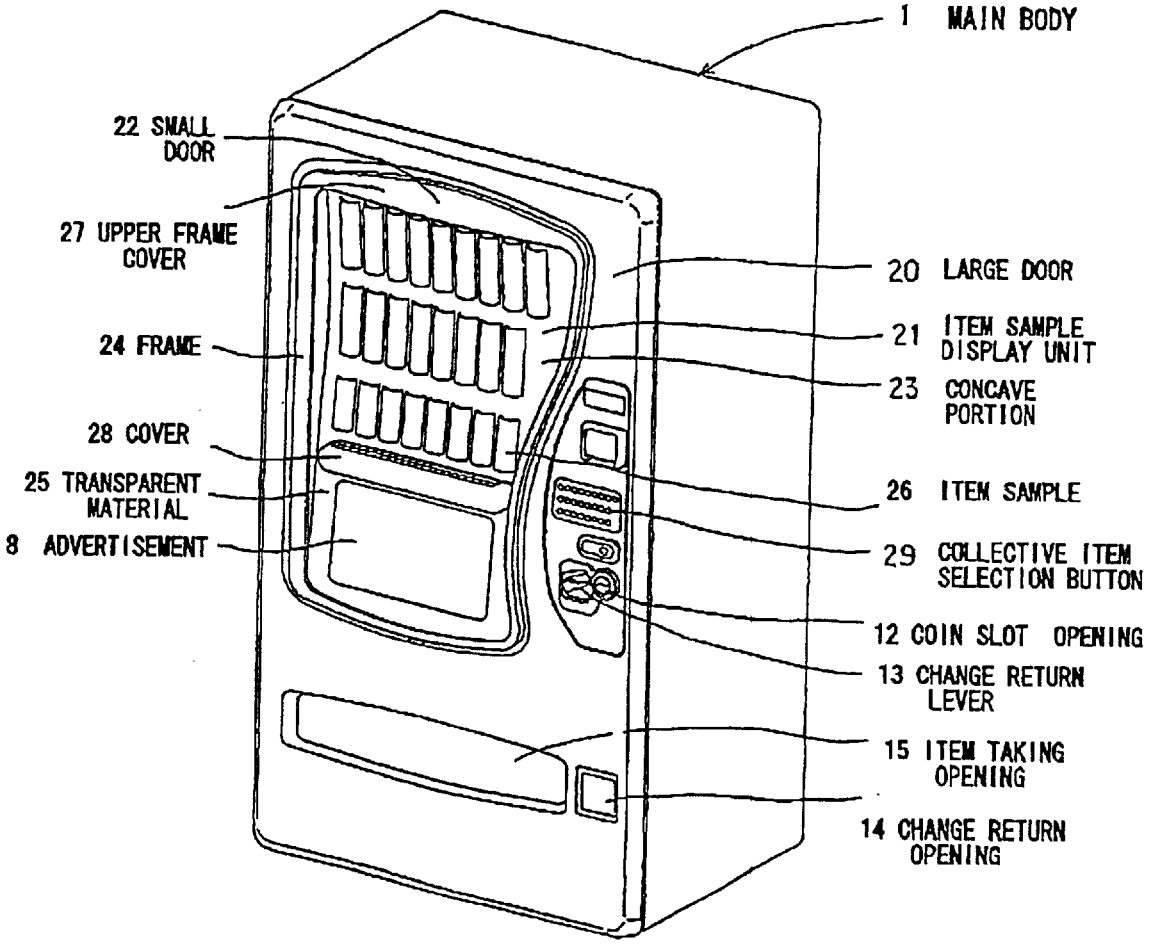
FIG. 4 is a perspective view of whole automatic vending machine with the door showing the second embodiment of the invention.
Figure 5:
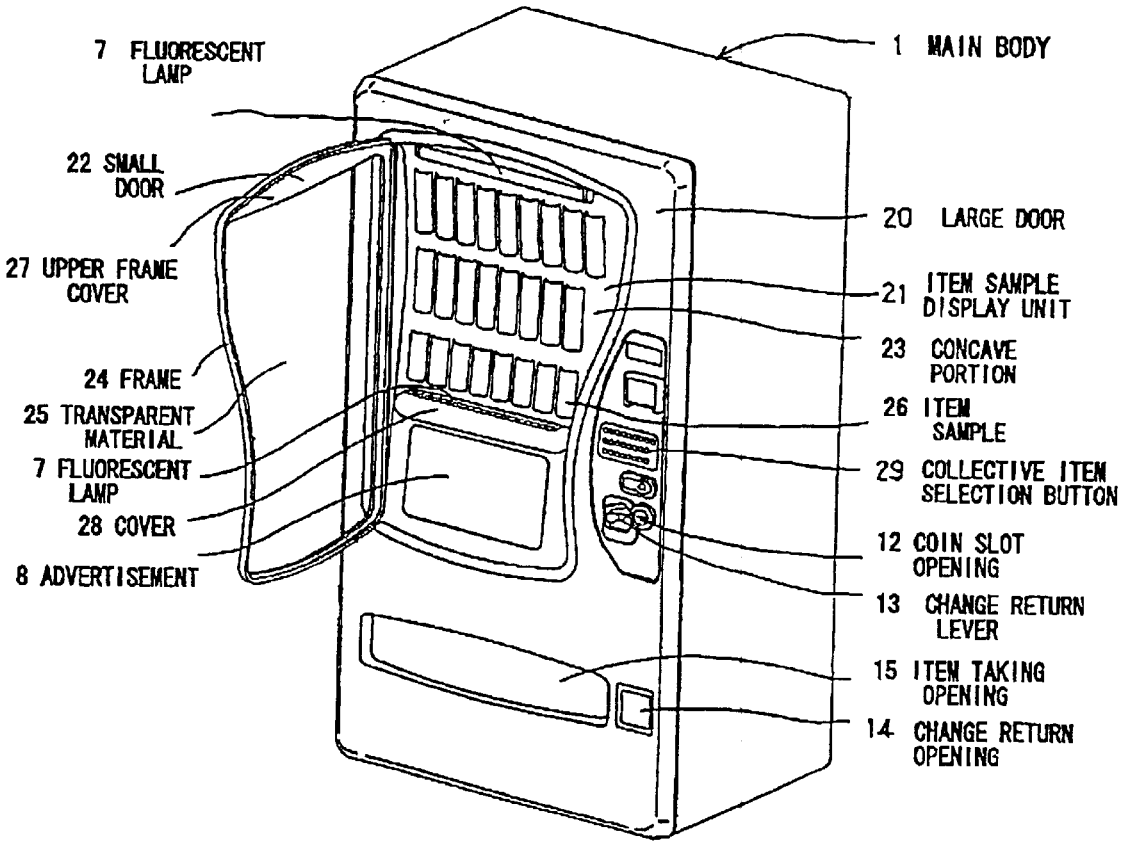
FIG. 5 is a perspective view of whole automatic vending machine with the small door in the open condition showing the second embodiment of the invention.

FIG. 4 is a perspective view of whole automatic vending machine with the door showing the second embodiment of the invention. The large door 20 is installed in the front surface of the automatic vending machine 1, the item sample display unit 21 is installed in a part of the outside of the large door 20, and the small door 22 is installed so that it covers the item sample display unit 21. The large door 20 is formed by one press molding of a molding material such as an iron plate, and the concave 23 which is a part of the door 20 is the item sample display unit 21. The circumference of the item sample display unit 21 is covered with the small door 22 which is formed by the transparent materials 25 equipped with the frame 24, and the item sample 26 and the advertisement 8 can be confirmed through the transparent material 25. FIG. 5 is a perspective view of whole automatic vending machine with the small door in the open condition showing the second embodiment of the invention. In order to increase the illumination effect of the item sample 26 of the invention, the sample 26 is in the vending form in comparison with the item sample 6 which is substantially same form as the item to be sold. Fluorescent lamp 7 is installed in the item sample display unit 21 to illuminate the item sample 26 vertically arranged on three stairs and the advertisement 8 provided under the sample 26. In more detail, the fluorescent lamp 7 is installed at the two places over the uppermost item sample on the item sample display unit 21 and under the lowermost item sample 26. The fluorescent lamp 7 over the uppermost item sample is arranged so that it is faced with the cover 27 of the small door 22 when the small door 22 is close, and the fluorescent lamp 7 under the lowermost item sample is arranged so that it is covered with the cover 28. The upper item sample 26 and the lower advertisement 8 are sufficiently illuminated by two fluorescent lamps vertically arranged. The item sample display unit 21 is formed by one press molding with the large door 20 so that horizontal portion of the middle stair on which the item sample 26 is arranged is curved in the inside direction of the automatic vending machine 1. Among the item sample 26 arranged on three stairs, the uppermost item sample 26 and the lowermost item sample 26 are arranged so that they are declined to the backside of the small door 22, and the middle item sample 26 is arranged so that it is not declined to the backside of the small door 22.

The coin slot opening 12, the collective item selection button 29, the change return lever 13, the change return opening 14 and the item-taking opening 15 are provided outside of the large door 20. The selection button can be removed from the small door 22 by providing the collective item selection button 29, whereby the customers can be easily watch the item to be selected.

As described above, in addition to the effects of the first embodiment of the invention, the fluorescent lamp 7 is vertically installed in only two places, although it has to be installed for the item sample 26 on each of plural stairs in conventional automatic vending machine. As a result, the power consumption can be saved. It is prevented by declining the item sample 26 on the uppermost stair that the upper side of the item sample 26 is locally highlighted under the upper fluorescent lamp 7. Similarly, it is prevented by declining the item sample 26 on the lowermost stair that the lower side of the item sample 26 is locally highlighted under the lower fluorescent lamp 7. Uneven illumination is not caused on the middle item sample 26 because the sample 26 is illuminated by two fluorescent lamps 7 installed at substantially same distance from the upper and lower places. As a result, it is possible that light to be illuminated from two fluorescent lamps 7 to all item sample 26 on the three stairs is equal. Further, where customers look at the item sample in front of the automatic vending machine, they are faced with the item sample 26 on each stair, because the item sample 26 on the uppermost stair is arranged downward from the eyes of customers and the item sample 26 on the lowermost stair is arranged upward from the eyes of customers. Namely, it is easy for customers to look at the item sample 26 and to select the item.

Figure 6:
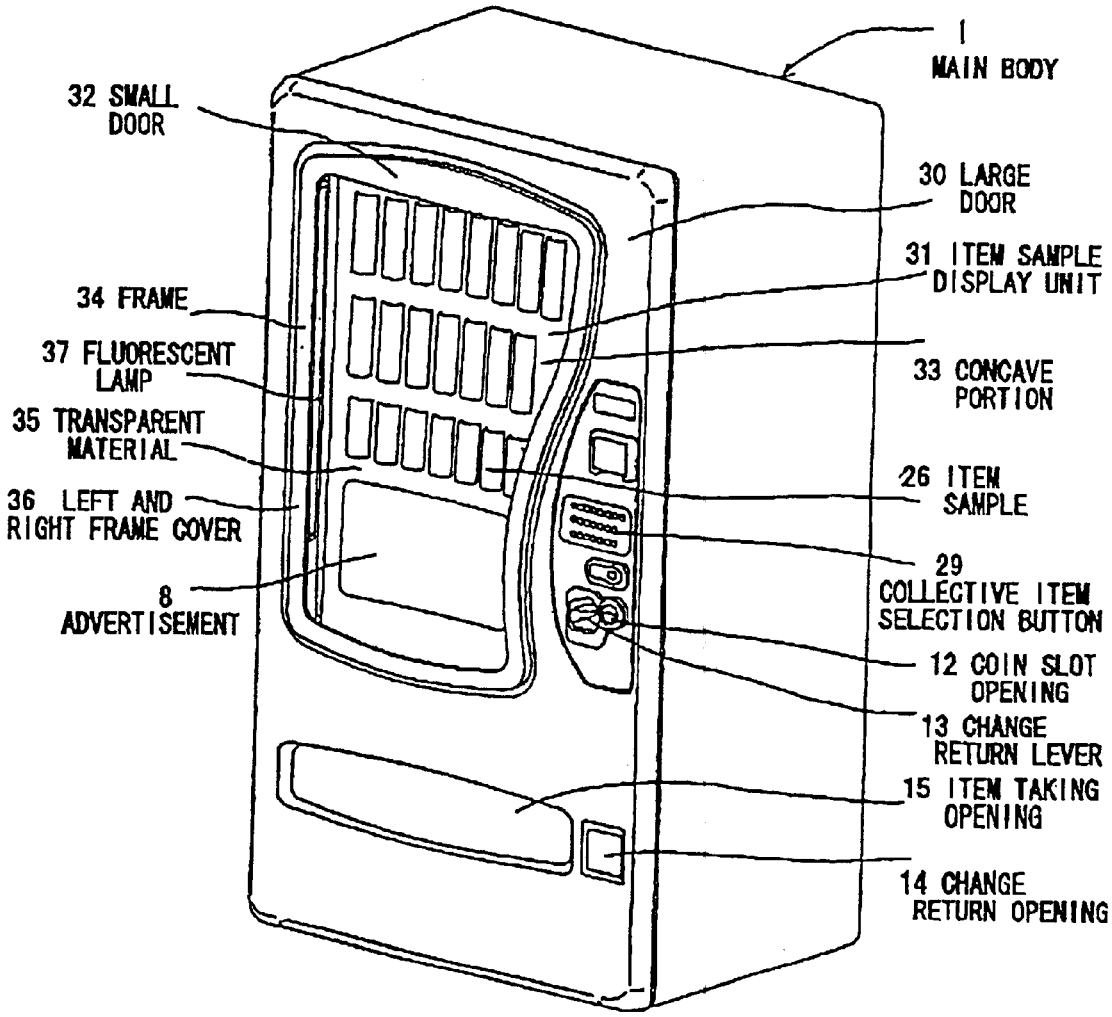
FIG. 6 is a perspective view of whole automatic vending machine with the door showing the third embodiment of the invention.
Figure 7:
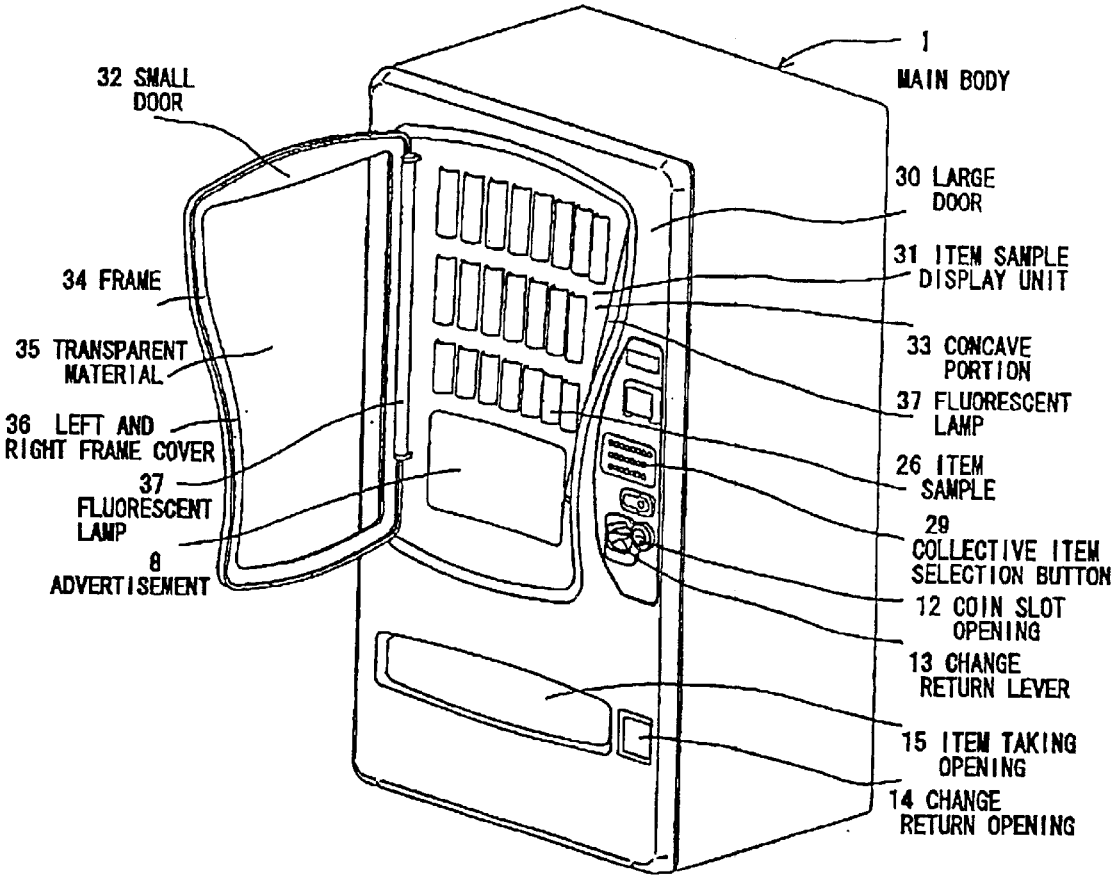
FIG. 7 is a perspective view of whole automatic vending machine with the small door in the open condition showing the third embodiment of the invention.

FIG. 6 is a perspective view of whole automatic vending machine with the door showing the third embodiment of the invention. The large door 30 is installed in the front surface of the automatic vending machine 1, the item sample display unit 31 is installed in a part of the outside of the large door 30, and the small door 32 is installed so that it covers the item sample display unit 31. The large door 30 is formed by one press molding of a molding material such as an iron plate, and the concave 33 which is a part of the door 30 is the item sample display unit 31. The circumference of the item sample display unit 31 is covered with the small door 32 which is formed by the transparent materials 35 equipped with the frame 34, and the item sample 26 and the advertisement 8 can be confirmed through the transparent material 35. FIG. 7 is a perspective view of whole automatic vending machine with the small door in the open condition showing the third embodiment of the invention. The fluorescent lamp 37 is installed in the item sample display unit 31 to illuminate the item sample 26 vertically arranged on three stairs and the advertisement 8 provided under the sample 26. In more detail, the fluorescent lamp 37 is installed at the two places in the right side of the rightmost item sample on the item sample display unit 31 and in the left side of the leftmost item sample 26. The upper item sample 26 and the lower advertisement 8 are sufficiently illuminated by two fluorescent lamps 37 horizontally arranged. Accordingly, customers do not watch the lamps 37 directly. The fluorescent lamp 37 in the right and left sides each is arranged so that it is faced with the cover 36 of the small door 22 when the small door 22 is close. The rightmost item sample 26 is arranged toward to the lamp direction installed in the lest side of the leftmost item sample 26 and the leftmost item sample 26 is arranged toward to the lamp direction installed in the right side of the rightmost item sample. The item sample display unit 31 is formed by one press molding with the large door 30 so that center portions of the item sample 26 to be arranged on the three stairs are curved in the inside direction of the automatic vending machine 1. The coin slot opening 12, the collective item selection button 29, the change return lever 13, the change return opening 14 and the item-taking opening 15 are provided outside of the large door 30.

As described above, in addition to the effects of the first embodiment of the invention, the fluorescent lamp 37 is horizontally installed at only two places, although it has to be installed for the item sample 26 on each of plural stairs in conventional automatic vending machine. As a result, the power consumption can be saved. The item sample 26 in the left side is directed to the right side direction in order to avoid strong exposure to the fluorescent lamp 37 in the left side. Similarly, the item sample 26 in the right side is directed to the left side in order to avoid strong exposure to the fluorescent lamp 37 in the right side. Uneven illumination is not caused on the middle item sample 26 because the sample 26 is illuminated by two fluorescent lamps 37 installed in the right and left sides. As a result, it is possible that light to be illuminated from two fluorescent lamps 37 to each item sample 26. Further, where customers look at the item sample in front of the automatic vending machine, they are faced with each item sample 26, because the item sample 26 in the left side is arranged to the right direction from the eyes of customers and the item sample 26 in the right side is arranged to the left direction from the eyes of customers. Namely, it is easy for customers to look at the item sample 26 and to select the item.

As explained above, according to the door for automatic vending machine of the invention, the item sample display unit is formed by one press molding with a part of the outside of the large door. As a result, the maintenance operations in the item sample display unit are simple, the structure of the door can be simplified, the weight of the door is reduced, and the door is strengthened. Also, the number of the illumination lamps can be reduced, the power consumption can be reduced, and light is uniformly exposed from the illumination lamps to each of the item samples.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching herein set forth.

What is claimed is:

1. A door for automatic vending machine comprising a first door unit capable of opening and closing and installed on a front surface of the automatic vending machine, and an item sample display unit, both of the first door unit and the item sample display unit being made by one molding;

wherein said item samples are arranged in a plurality of rows in said display unit, so that the item samples in a center row or near the center row are curved toward the back surface of the door unit and so that the item samples in the row higher than those in or near the center row are declined downward and the item samples in the row lower than those in or near the center row are inclined upward, and an illumination lamp is installed in an upper portion of the item samples in the uppermost row and in a lower portion of the item samples in the lowermost row, respectively.

2. A door for automatic vending machine comprising a first door unit capable of opening and closing and installed on a front surface of the automatic vending machine, and an item sample display unit, both of the first door unit and the item sample display unit being made by one molding;

wherein said item samples are arranged in a plurality of rows in said display unit, so that the item samples in a center portion or near the center portion are curved toward the back surface of the door unit and so that the item samples in the left side of the center portion are declined to the right and the item samples in the right side of the center portion are declined to the left, and an illumination lamp is installed in the left side of the item samples in the most left side and in the right side of the item samples in the most right side, respectively.

* * * * *